United States Patent [19]

Ryan

[11] Patent Number: 4,592,549

[45] Date of Patent: Jun. 3, 1986

[54] BALL HARNESS

[76] Inventor: James A. Ryan, 36151 North Grand Oaks Ct., Gurnee, Ill. 60031

[21] Appl. No.: 688,177

[22] Filed: Jan. 2, 1985

[51] Int. Cl.[4] ..... A63B 43/02; A63B 67/10; A63B 69/00

[52] U.S. Cl. ..... 273/58 C; 273/26 E; 273/413

[58] Field of Search ..... 273/58 C, 200 R, 184 B, 273/185 C, 26 E, 29 A, 414, 413, 411

[56] References Cited

U.S. PATENT DOCUMENTS

| | | | |
|---|---|---|---|
| 660,787 | 10/1900 | Bissell | 273/58 C |
| 3,351,343 | 11/1967 | Papp | 273/26 E |
| 3,709,491 | 1/1973 | Minchin | 273/58 C |
| 4,147,353 | 4/1979 | Moore | 273/58 C |
| 4,239,228 | 12/1980 | Norman et al. | 273/DIG. 30 |

*Primary Examiner*—George J. Marlo

[57] ABSTRACT

A ball harness comprising a parallelogram of straps with radially extending straps from the corners of the parallelogram, adjustably affixed together and interlayered by interlocking hoop and loop materials so as to firmly wrap a ball.

1 Claim, 9 Drawing Figures

BALL HARNESS

BACKGROUND OF THE INVENTION

1. Field of the Invention

In the games of baseball and soccer, to name only two, the athlete must practice striking the ball. Pitching machines for baseball were developed, and they enabled a batter to develop his timing and swing. However, the pitching machine is expensive and cumbersome and has been the source of serious injuries. Also, it cannot place the ball precisely and repeatedly to help the batter develop a consistent swing plane.

Alternatively, and again using the games of baseball or soccer as examples, two or more athletes can practice together in a game situation. However, striking a thrown or placed ball in the open or in a enclosure does not allow sufficient rhythmic and consistent repetition for maximum training effect.

Most playing fields contain a backstop structure made substantially of chain-link mesh. In my simultaneously pending application entitled "Athletic Swing Plane Trainer" I disclose an apparatus including a ball suspended from a chain-link mesh backstop. In my simultaneously pending application entitled "Hook and Fork for Chain-link Mesh" I disclose the combination of hook and fork including a descending cord from which cord is appended a supported or harnessed playing ball.

This invention relates to all athletic devices which are suspended from an overhead structure.

2. Description of the Prior Art

It is, of course, old to suspend a ball or toy for play. Doyle's "Baseball Batting Apparatus", U.S. Pat. No. 831,605 shows a simple suspended ball with elastic return cords.

Bearn's "Batting Practice Stand", U.S. Pat. No. 4,258,916 is a swinging arm apparatus with no similarity in function to my invention.

Hynes' "Batting Practice Device", U.S. Pat. No. 4,322,075 is again a swinging arm apparatus, with a cord combined with the arm. Neither of these devices allows an actual game ball to be inserted and removed.

The means of harnessing the actual game ball in a training apparatus is the object of my invention. It is, of course, old to fasten a cord directly to a ball or to use a netting.

In the field of playground tether balls, straps of fixed size are disclosed by Minchin's "Tether Ball Holder," U.S. Pat. No. 3,709,491 and Papp's "Game Ball and Tethering Means Therefore," U.S. Pat. No. 3,351,343. Neither one is a sufficiently durable and safe harness, and neither functions as does my invention.

BRIEF SUMMARY OF THE INVENTION

It is the principal object of my invention to provide a harness into which a game ball can be fastened, with integral tabs allowing the harnessed ball to be used in a training apparatus.

An exemplary embodiment of the invention achieves the foregoing objects in a safe and durable harness including a plurality of fabric straps, the harness being adjustable about biaxial circumferences of a ball, and tabs being integral to the harness for connection of cords.

DETAILED DESCRIPTION

Figure 1:
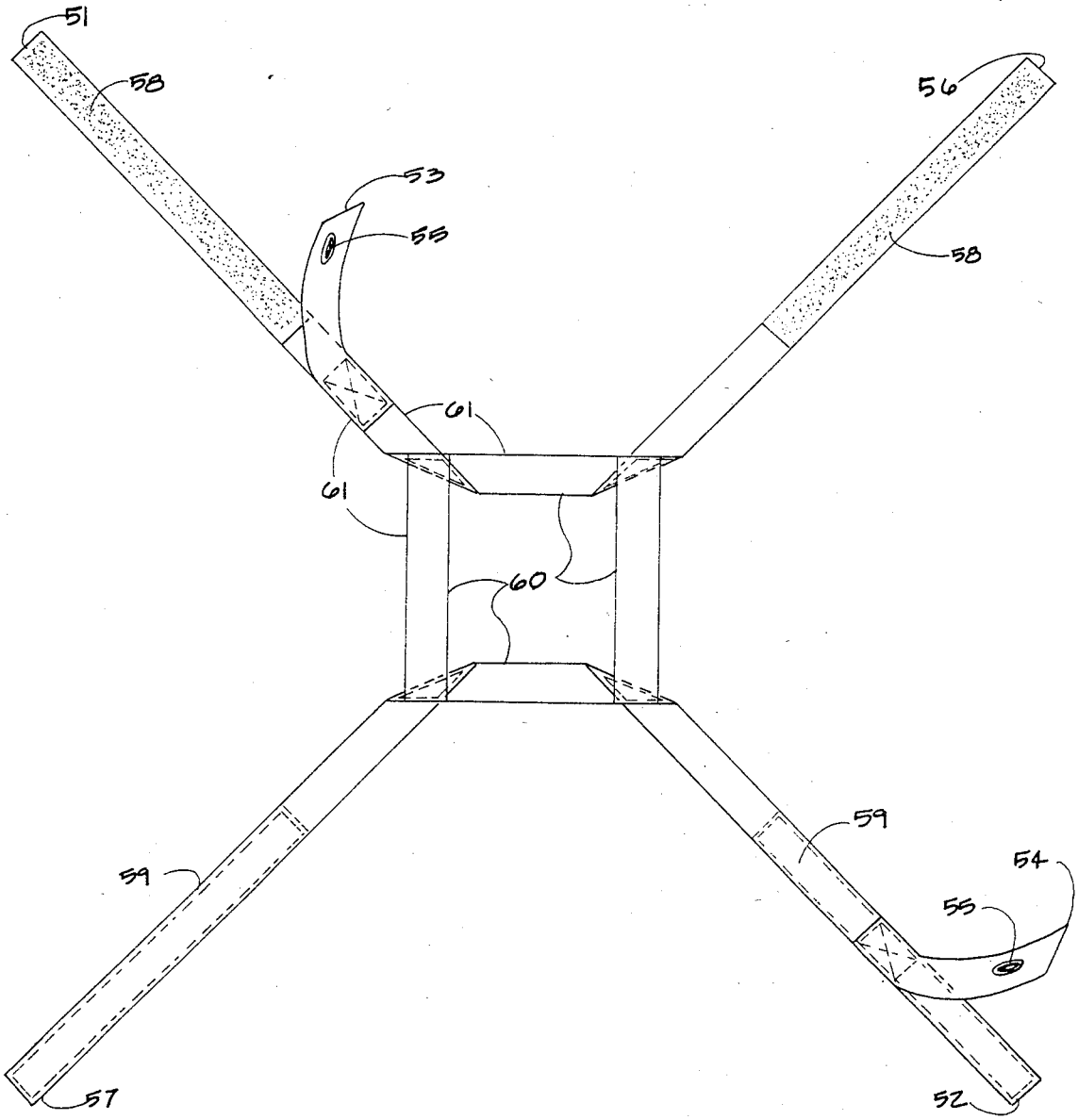
FIG. 1 is a plan view of the empty harness device laid out upon a flat surface and made according to the invention, showing the parallelogram of strapwork which leaves the face of the ball exposed after the harness is wrapped about the ball.

Exemplary embodiments of a sports training apparatus made according to the invention are illustrated in the drawings.

Turning to FIG. 1, the harness is formed of a fabric having inherent strength, durability and flexibility. The material is day-glow orange color in the preferred embodiment. The material must also be resistant to stretching or deformation, either along the direction of the weave, or along the bias of the fabric. The center of the harness comprises a parallelogram (60) fashioned of fabric strapping. Fabric strapping (51), (52), (56) and (57) extends radially from each corner of the parallelogram so as to form equal obtuse angles (61) between the extending strap and each adjacent face of the parallelogram. Two radially opposing straps (51) and (52) include grommeted tabs (53) and (54). The grommeted tab (53) is located on strap (51) immediately beyond the corner of the parallelogram.

Radially outward on the embodiment illustrated in FIG. 1, is Velcro material (58) and (59) which is attached to one face of each of the projecting fabric straps. The companion portions of the Velcro material are indicated as Velcro pile (58) and Velcro loop (59). Each projecting fabric strap is approximately one-half of the circumference of the ball which is to be inserted into the harness.

In the embodiment illustrated in FIG. 1, the projecting fabric strap (51) is the first strap to be wrapped around the ball which will ultimately be securely wrapped within the harness. For purposes of describing the positioning of the Velcro material on one of the two faces of the extending fabric strap, the outward face of the harness will be the face that appears in FIG. 1 and will be the face to which the grommeted tabs (53) and (54) are affixed. The other face will be referred to as the inner face.

Thus, beginning with fabric strap (51), the pile portion of the Velcro material (as distinguished from the loop portion of the Velcro material) will be securely fastened to the outer face of the fabric. The Velcro would extend from the radially outmost portion of the fabric strap, inward to the base of the grommeted tab (53). On the radially opposite fabric strap (52) the companion loop portion (59) of the Velcro material would be securely fastened to the inner face of the fabric strap, with the Velcro material being of approximately equivalent length to the companion Velcro which is attached to fabric strap (51).

As shown, there are two further fabric straps (56) and (57) extending radially outward from the central parallelogram in the center of the harness. Strap (56) has Velcro pile material (58) fixed to the outward face of the strap, extending from the extremity of the strap radially inward for a suitable distance. Strap (57) is radially opposite from strap (56), and has the companion Velcro loop (59) fastened to the inward face of said strap (57).

In the central portion of the harness assembly, a parallelogram (60) is constructed of the fabric strapping. In the preferred embodiment, two opposing sides of the parallelogram are comprised of the middle section of the lengthy pieces, continuous from the radial extremes of straps (51) and (57), and from the radial extremes of straps (52) and (56).

Two substantially shorter pieces of strapping form the final opposing sides of the parallelogram. By folding the longer strips on the half-bias, and attaching them where folded to the shorter strips, the preferred embodiment of the parallelogram is constructed and securely fastened at the corners thereof. The longest distance between non-adjacent corners of the parallelogram is less than one-half the circumference of the ball which is to be inserted into the harness.

The best mode of attaching the folded strappings to the shorter strappings, to construct the central parallelogram, is by hand or machine stitching using a strong and durable thread.

Similarly, the best mode of attaching the Velcro material to the strapping, and of attaching the grommeted tabs to the strapping, is by means of hand or machine stitching using a strong and durable thread. The grommets (55) are affixed by hand or machine to the fabric tabs (53) and (54).

Figure 5:
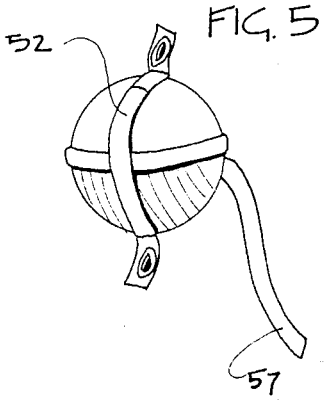
FIG. 5 illustrates, in perspective, the fourth step of the harness being wrapped about the ball.
Figure 6:
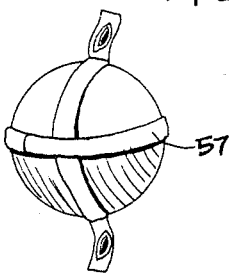
FIG. 6 illustrates, in perspective, the completely wrapped harness after the fifth step of wrapping.
Figure 7:
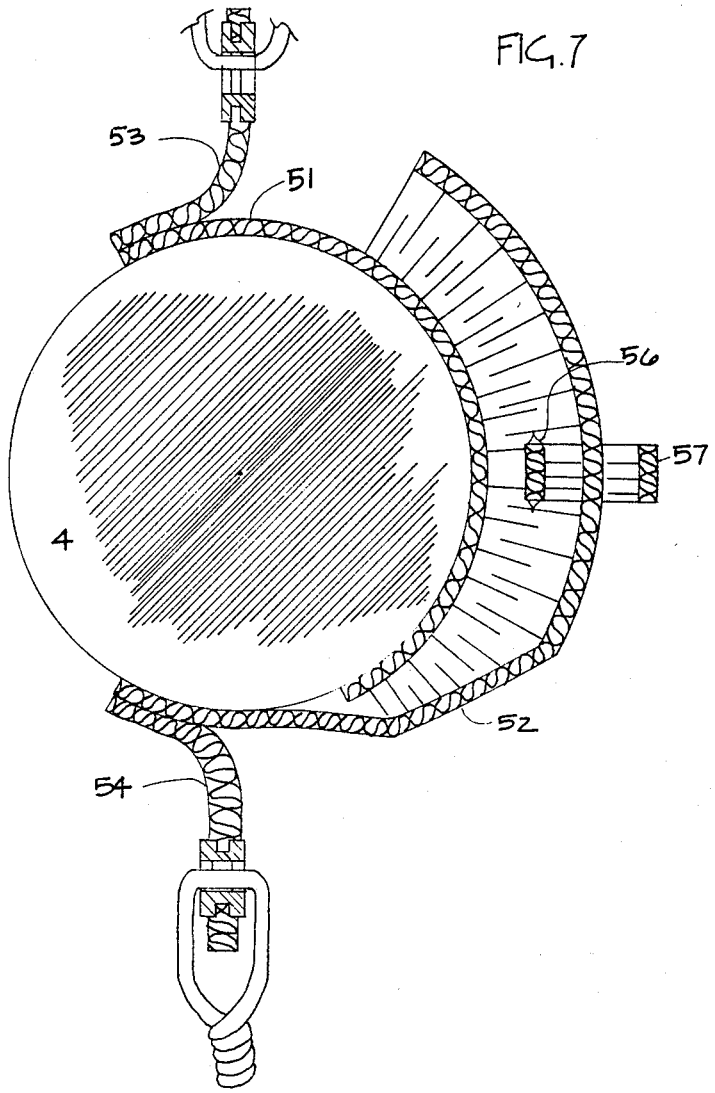
FIG. 7 is a side sectional view of the ball enclosed in the harness with cords attached to the two grommeted tabs which are made integral to the harness according to the invention.
Figure 9:
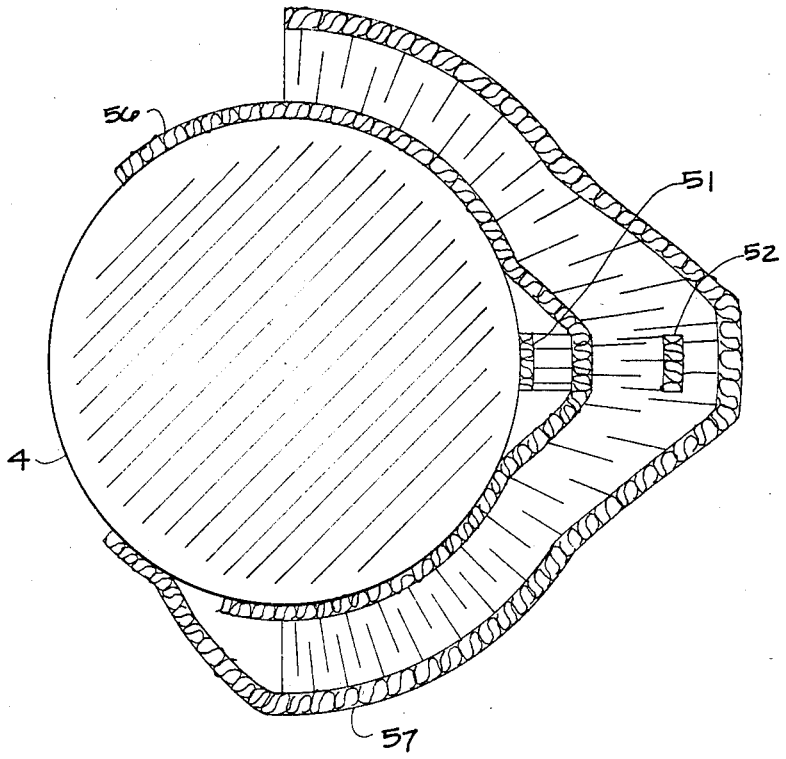
FIG. 9 is a top sectional view of the harness wrapped about the ball.

FIGS. 2, 3, 4, 5 and 6 illustrate the method of sequentially wrapping the harness strappings about the ball, in order to attain the overlap of wrappings that is further illustrated in FIGS. 7 and 9.

Figure 2:
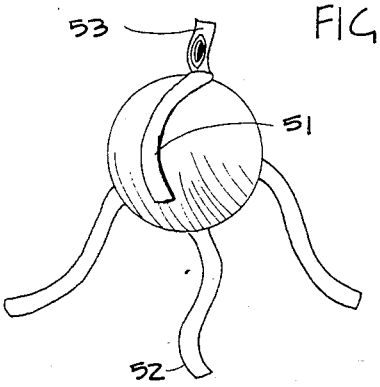
FIG. 2 illustrates, in perspective, the first step of the harness being wrapped about the ball.

In FIG. 2, a strap (51) which has Velcro pile material upon the outward face of the strapping and which has a grommeted tab (53) on the same fabric strap face as the Velcro pile, is wrapped downward along a longitudinal circumference so that the grommeted tab is at the uppermost point of the ball.

Figure 3:
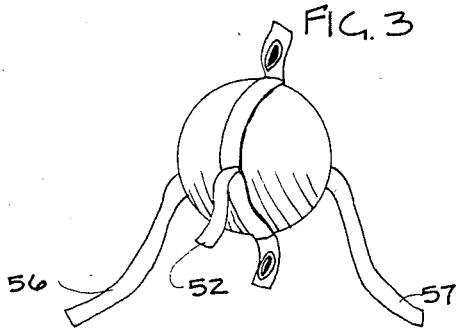
FIG. 3 illustrates, in perspective, the second step of the harness being wrapped about the ball.

FIG. 3 illustrates the next step of wrapping, which requires the radially opposite strap (52) to be brought around the bottommost portion of the ball and then upwards along the same longitudinal circumference. The Velcro loop material on the second strap (52) is pressed to the Velcro pile on strap (51). As illustrated in FIG. 3, the second strap (52) is not brought upwards above the horizontal circumference of the ball as of yet. That second strap (52) also has a grommeted tab (55).

Figure 4:
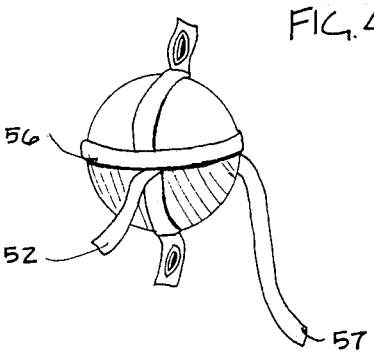
FIG. 4 illustrates, in perspective, the third step of the harness being wrapped about the ball.

FIG. 4 illustrates the next step of wrapping the harness, in which one of the latitudinal straps (56) is wrapped around the horizontal circumference of the ball with the Velcro pile facing outward.

FIG. 5 illustrates the fourth step in wrapping the harness, in which the ascending strap (52), which was only partially wrapped in FIG. 3, is now brought upwards along the longitudinal circumference of the ball to complete the circumferential wrapping that includes both of the grommeted tabs.

FIG. 6 illustrates the fifth and final step in wrapping the harness about the ball, in which the remaining latitudinal strap is brought around the horizontal circumference of the ball, said remaining strap having Velcro loop material upon the inner fabric strap face, with the Velcro loop material being used to fastened against the Velcro pile material of the prior latitudinally positioned strap (56).

Figure 8:
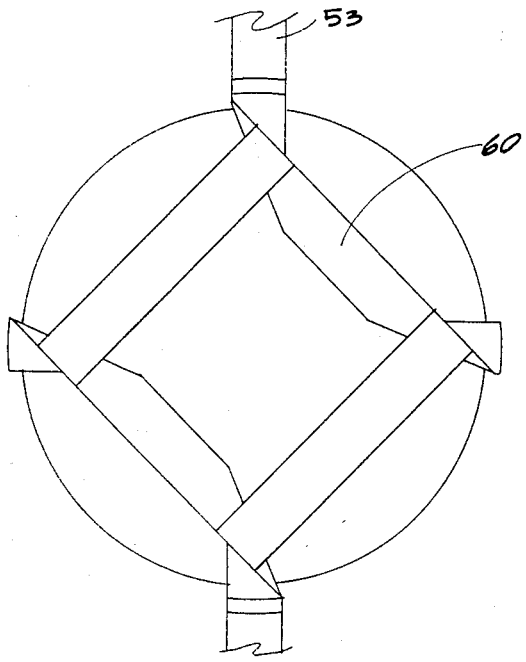
FIG. 8 is a top sectional view of the ball enclosed in the harness with the parallelogram of strapwork and the top grommeted tab illustrated.

FIG. 8 illustrates the appearance of the ball in perspective with the parallelogram (60) portion of the harness positioned on one face of the ball, and the grommeted tab (53) appearing at the uppermost portion of the ball.

FIG. 7 illustrates, in a side sectional view, the successive wrappings applied against the face of the softball opposite from the face upon which the parallelogram is situated. The reference numerals in FIG. 7 correspond to FIG. 3.

FIG. 9 illustrates, in a top sectional view, the same pattern of alternating harness wrappings about the horizontal circumference of the ball, with the point of intersection of all wrappings commencing outward from the face of the ball with the vertically descending strap being first against the face of the ball, the first horizontal strap being next positioned against the first strap, the vertically ascending strap being the third strap proceeding outward from the ball at the point of intersection, and with the remaining horizontal strap being the outermost wrapping at the point of intersection. The reference numerals in FIG. 9 correspond to FIG. 3.

It will be appreciated that the progressive steps of wrapping Velcroed strapping about the ball makes this apparatus strong, durable, safe and easy to use.

It will, of course, be understood that various details of construction, combination and assembly may be modified throughout a range of equivalence, and it is, therefore, not the purpose to limited the scope of the present invention otherwise than as necessitated by the scope of the appended claims.

What is claimed is:

1. A ball harness comprising:

a. a plurality of non-stretchable fabric straps interfastened by stitching, and defining a parallelogram with radial extensions from the corners thereof;

b. a means of fastening cords thereto, comprising integral grommeted tabs fastened by stitching, said tabs being affixed to the outward face of said straps as the plurality of straps encircles a ball;

c. the longest distance between non-adjacent corners of said parallelogram being less than one-half of the circumference of the ball which is to be inserted into the harness;

d. said radial extensions being radial straps extending from each corner of said parallelogram, so that as to each radial strap there are formed equal obtuse angles between the extending radial strap and each adjacent face of the parallelogram;

e. each pair of radially opposed straps having companion detachably interlocking hook and loop materials affixed, one of said material being affixed to the outward face of one opposed strap and the other of said materials being affixed to the inward face of the other opposed strap.

* * * * *